US005860470A

United States Patent [19]

Andersson et al.

[11] Patent Number: 5,860,470

[45] Date of Patent: Jan. 19, 1999

[54] COVER ROUND A PLATE HEAT EXCHANGER

[75] Inventors: Torgny Andersson, Marieholm; Ralf Blomgren, Skanör; Bernt Tagesson, Lund, all of Sweden

[73] Assignee: Alfa Laval AB, Lund, Sweden

[21] Appl. No.: 793,179

[22] PCT Filed: Aug. 30, 1995

[86] PCT No.: PCT/SE95/00976

§ 371 Date: Feb. 20, 1997

§ 102(e) Date: Feb. 20, 1997

[87] PCT Pub. No.: WO96/07072

PCT Pub. Date: Mar. 7, 1996

[30] Foreign Application Priority Data

Aug. 31, 1994 [SE] Sweden ..... 9402903

[51] Int. Cl.[6] ..... F28F 3/08; F28F 9/00

[52] U.S. Cl. ..... 165/70; 165/134.1; 165/157; 165/167; 165/DIG. 356

[58] Field of Search ..... 165/70, 157, 134.1, 165/166, 167

[56] References Cited

U.S. PATENT DOCUMENTS

| | | | |
|---|---|---|---|
| 2,617,634 | 11/1952 | Jendrassik | 165/157 X |
| 3,099,520 | 7/1963 | Hallström | 165/70 X |
| 4,607,684 | 8/1986 | Wiard et al. . | |

FOREIGN PATENT DOCUMENTS

| | | | |
|---|---|---|---|
| 1329409 | 4/1963 | France | 165/166 |
| 1 127 923 | 4/1962 | Germany . | |
| 56-987 | 1/1981 | Japan | 165/166 |
| 59-41796 | 3/1984 | Japan | 165/166 |
| 115938 | 3/1946 | Sweden | 165/167 |
| 961419 | 6/1964 | United Kingdom | 165/166 |
| 1 500 917 | 2/1978 | United Kingdom . | |
| 2 280 020 | 1/1995 | United Kingdom . | |

OTHER PUBLICATIONS

PCT Int. Search Report.

*Primary Examiner*—Allen Flanigan
*Attorney, Agent, or Firm*—Fish & Richardson P.C.

[57] ABSTRACT

The present invention refers to a plate heat exchanger (1) comprising a frame (2) with two end plates (3,4) and between them a package (5) of heat transfer plates (6) with intermediate gaskets, which delimit flow spaces for at least two heat transfer fluids, and a cover (8) extending round said package (5). The cover (8) abuts closely towards the end plates (3,4) and is arranged on distance from said package (5) so that a sealed space towards the surrounding atmosphere is created between the cover (8) and said package (5).

8 Claims, 5 Drawing Sheets

COVER ROUND A PLATE HEAT EXCHANGER

FIELD OF THE INVENTION

The present invention refers to a plate heat exchanger comprising a frame with two end plates and between them a package of heat transfer plates with intermediate gaskets, which define flow spaces for at least two heat transfer fluids, and a cover extending around said package.

BACKGROUND OF THE INVENTION

A plate heat exchanger of the above mentioned kind is known through GB 1 500 917. The previous known plate heat exchanger is provided with a cover of rubber material or similar which is moulded around the plate heat exchanger to prevent leakage to flow out to the surrounding atmosphere.

Plate heat exchangers, used at high temperatures, often require frequent gasket replacement, owing to hardening of the gaskets, which deteriorates the sealing ability. Mostly it is the influence from the oxygen in surrounding air in connection with heightened temperature, which causes the breaking down of the rubber material. The choice of heat transfer fluid in the plate heat exchanger is of minor importance. If the gaskets are protected, so that they will not contact the surrounding air during operation, a considerable increase of life at high temperatures can be attained.

One way to achieve this could be to locate the plate heat exchanger in a hermetic container. Such a container could become very expensive, in particular for larger plate heat exchangers. An additional problem with a hermetic container for a plate heat exchanger is that a hydrostatic test and inspection must be allowed. This means that the container must be able to be assembled and dismantled on a plate heat exchanger already tightened.

To embed the package of heat transfer plates, as proposed in GB 1 500 917, does not solve the problem sufficiently. A moulded cover cannot be dismantled in a simple way and besides the cover will assume a rather high temperature and thus aging in the same way as the rubber gaskets. A cover must also function and seal properly despite huge deflection of the end plates during operation, which a moulded cover does not.

SUMMARY OF THE INVENTION

An object with the present invention is to achieve a simple mountable and dismountable cover, which protects the gaskets in the plate heat exchanger from an attack by the surrounding oxygen.

These objects are reached with the present invention, which principally is characterized in that the cover abuts closely towards the end plates and is arranged at a distance from said package so that towards the surrounding atmosphere sealed space is created between the cover and said package.

By covering the parts of the plate heat exchanger, where the gaskets are exposed to the surrounding atmosphere with a cover according to the present invention, it is protected from the harmful influence of the oxygen on the gasket material. The cover can be made so tight that no exchange of gas occurs around the package. The space between the cover and the package can be evacuated or filled with inert gas, such as nitrogen gas or carbon dioxide. As an alternative a continuous flow of inert gas may pass in the space between the cover and the package. The inert gas may also consist of steam. The advantage of steam is its accessibility in most installations.

The invention also refers to a method of protecting gaskets in a plate heat exchanger from being exposed to the oxygen in the surrounding atmosphere after the tightening of the plate heat exchanger, in which the parts of the gaskets of the plate heat exchanger exposed to the surrounding atmosphere are covered by a cover arranged on a distance from the gaskets, and in which the space between the cover and the gaskets is evacuated or is supplied with inert gas.

BRIEF DESCRIPTION OF THE DRAWINGS

The invention will be described more particularly in the following with reference to the accompanying drawings, in which.

DETAILED DESCRIPTION

Figure 2:
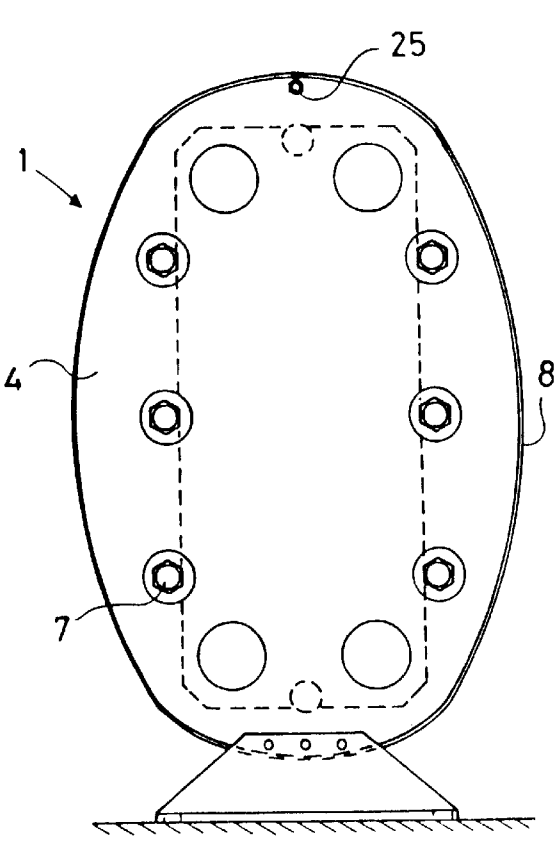
FIG. 2 shows an end-view of the plate heat exchanger according to FIG. 1.
Figure 1:
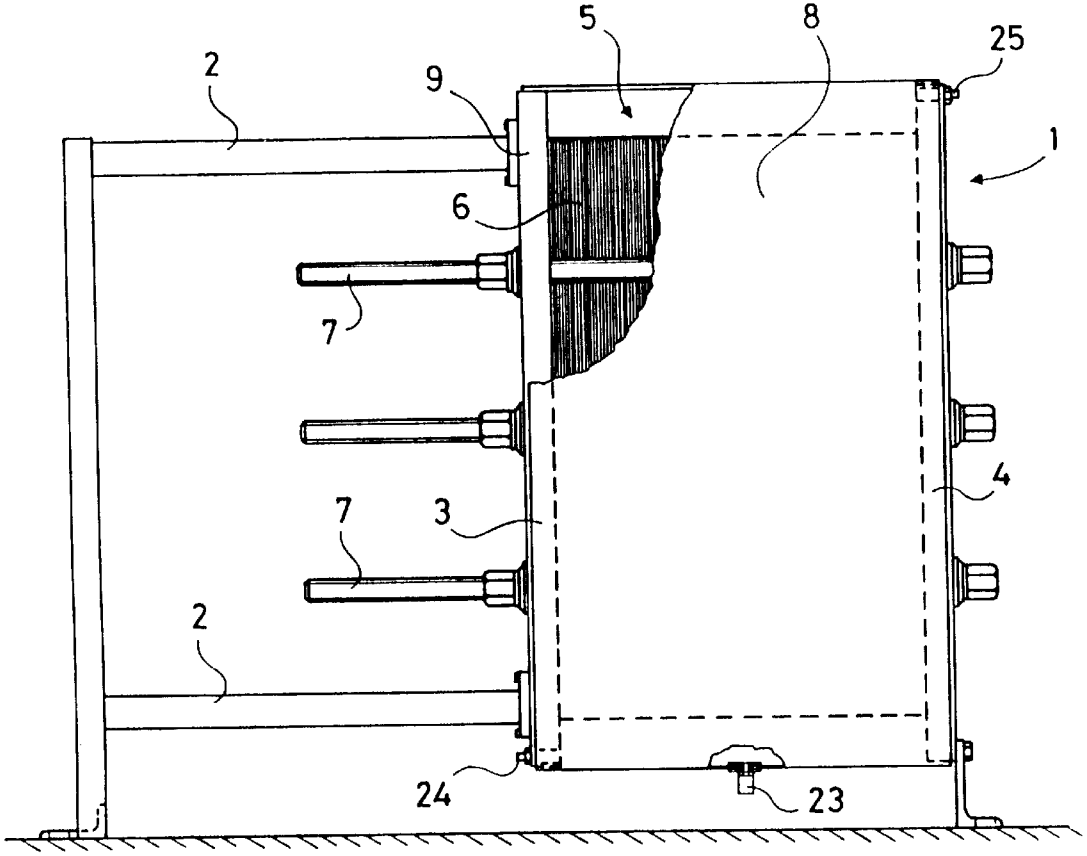
FIG. 1 shows a schematic side-view of a plate heat exchanger according to the invention.

FIGS. 1 and 2 show a plate heat exchanger 1, comprising a frame with an upper and a lower carrying bar 2, a supporting column and two end plates 3 and 4, namely a front pressure plate and a rear frame plate, and between them a package 5 of heat transfer plates 6 with intermediate gaskets. The plate heat exchanger 1 is in a conventional way clamped together by means of tightening bolts 7 extending between the end plates 3 and 4. A cover 8 is arranged around the package 5 and abuts towards the outer edge 9 of the end plates 3 and 4. In addition, there is shown a drainage valve 23, in the lower portion of the cover 8, and connecting nipples 24 and 25.

Figure 3:
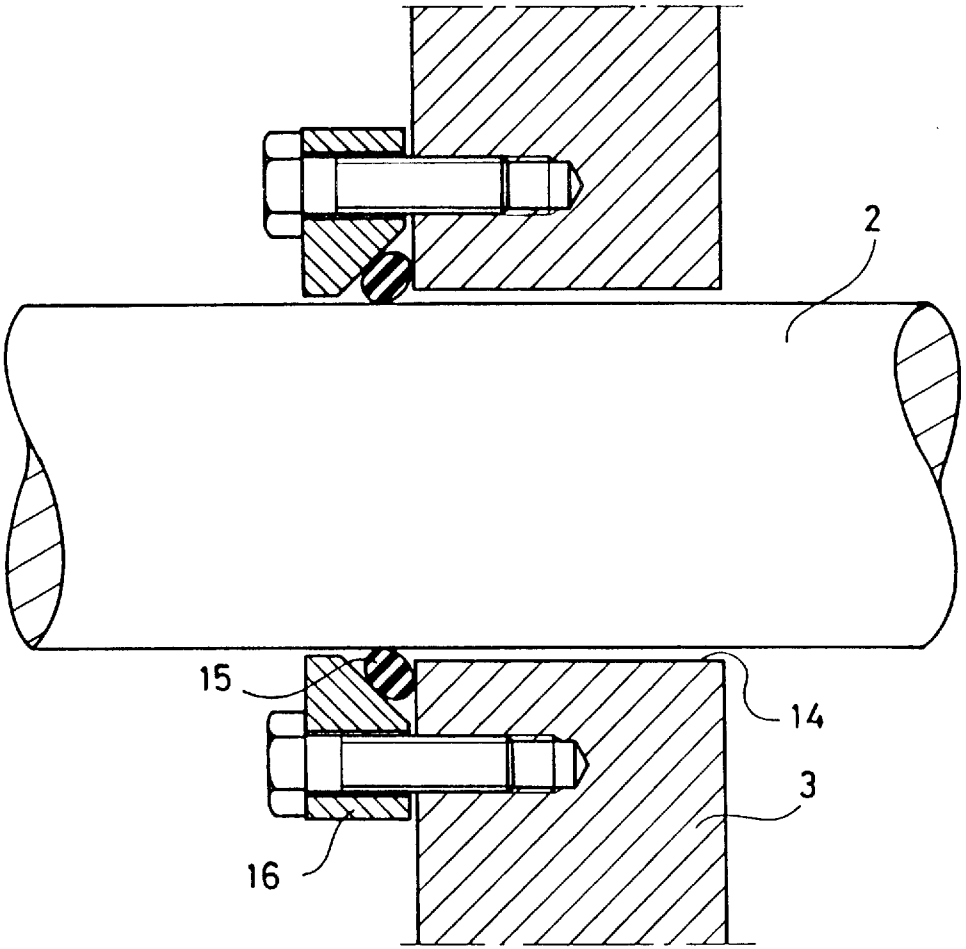
FIG. 3 shows a cross-section through the end plate near the carrying bar in the plate heat exchanger according to FIG. 1.

FIG. 3 shows the end plate 3 provided with a recess 14 for the carrying bar 2. On the exterior of the end plate 3 a seal 15 is provided, in the shape of an O-ring, which is pressed towards the end plate 3 and the carrying bar 2 by means of a joint washer 16 screwed in the end plate 3.

Figure 4:
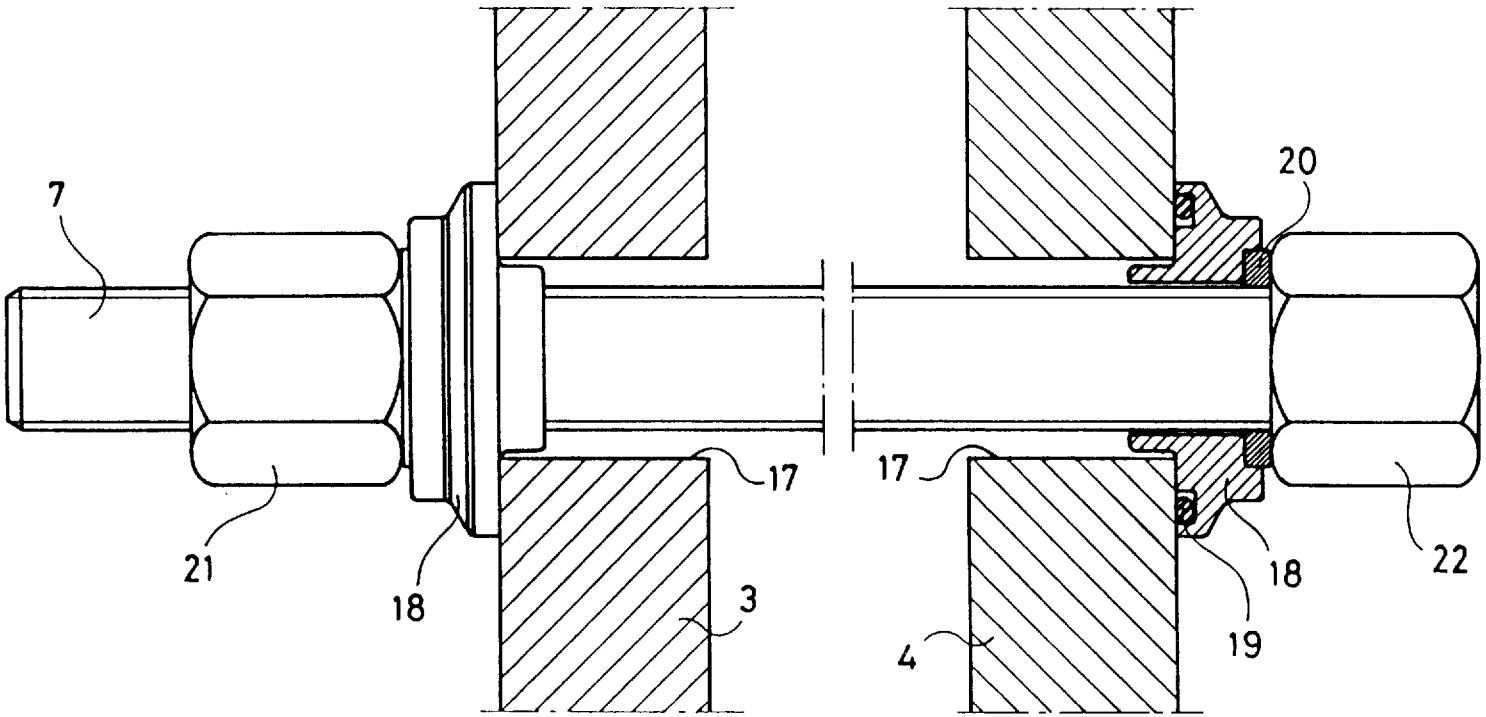
FIG. 4 shows a cross-section through the end plates near a tightening bolt in the plate heat exchanger according to FIG. 1.

FIG. 4 shows a tightening bolt 7, extending through a recess 17 in the end plates 3 and 4. On the exterior of each end plate 3 and 4 a joint washer 18 is provided, which by means of a seal 19 and 20 seals towards each end plate 3 and 4, and seals towards the nut 21 and 22 of the tightening bolt.

Figure 6:
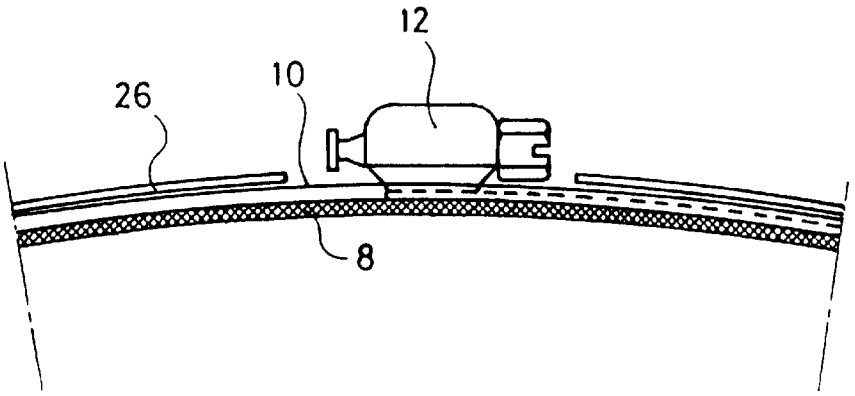
FIG. 6 shows an enlargement in detail of a tension means to hold the cover closely towards the end plate.
Figure 5:
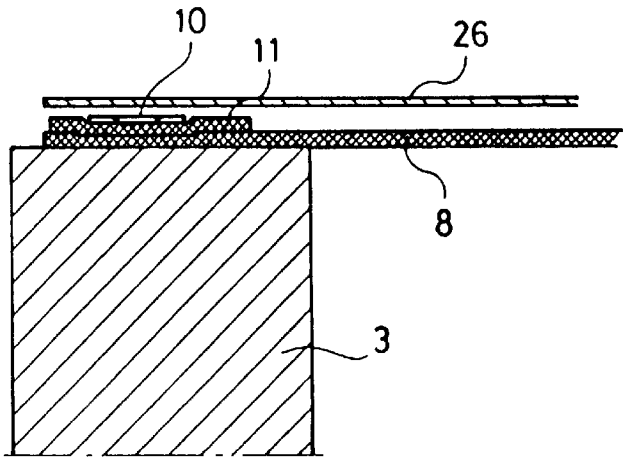
FIG. 5 shows an enlargement in detail of the cover abutting towards the end plate in the plate heat exchanger according to FIG. 1.

FIG. 5 and 6 show the clamping of the cover 8 to one end plate 3. A tension means, in shape of a strap 10, and a tension bolt 12 press the cover 8 and an intermediate protective strip 11 towards the end plate 3. In addition an outer protective shield 26 is shown.

Figure 9:
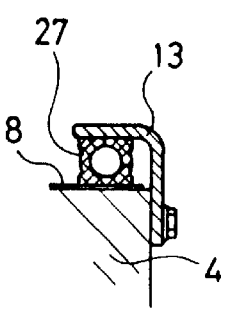
FIG. 9 shows an enlargement in detail of the cover abutting towards the end plate in the plate heat exchanger according to FIG. 7.
Figure 8:
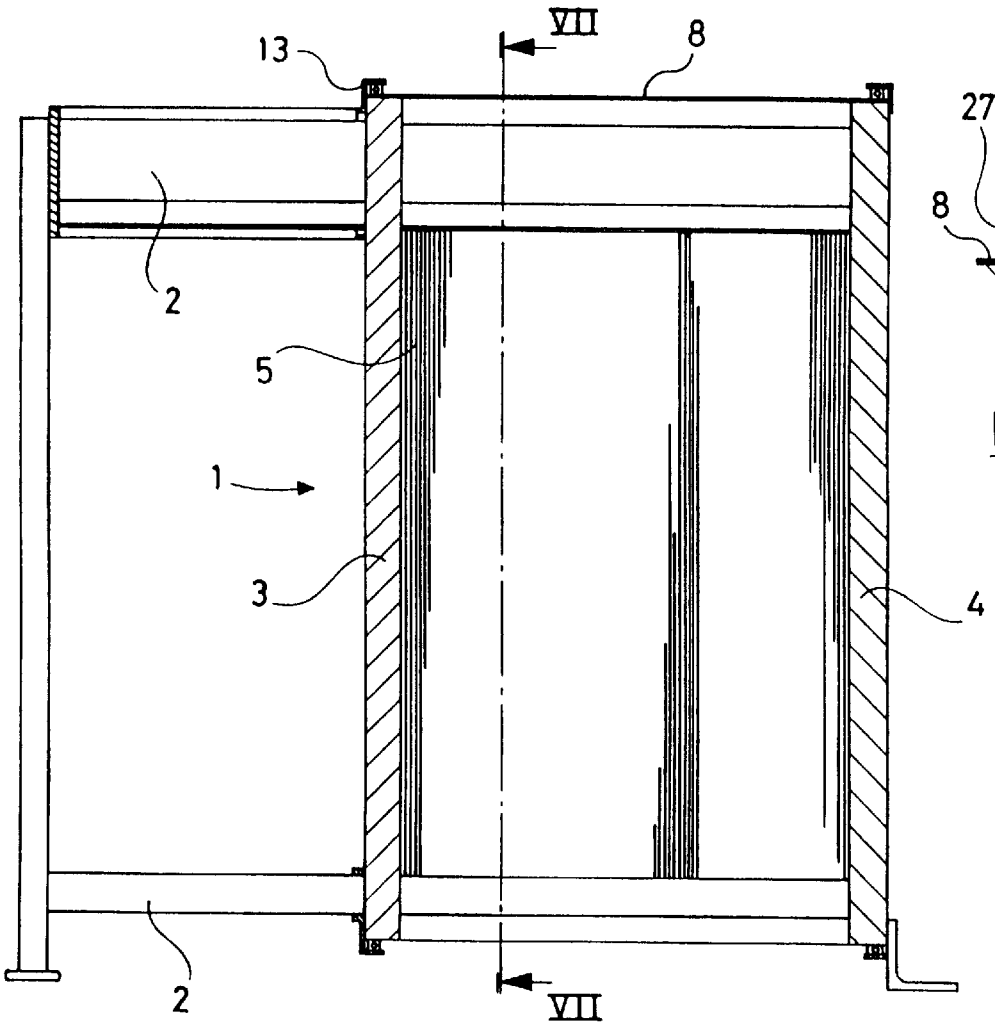
FIG. 8 shows a schematic cross-section from the side of the plate heat exchanger according to FIG. 7.
Figure 7:
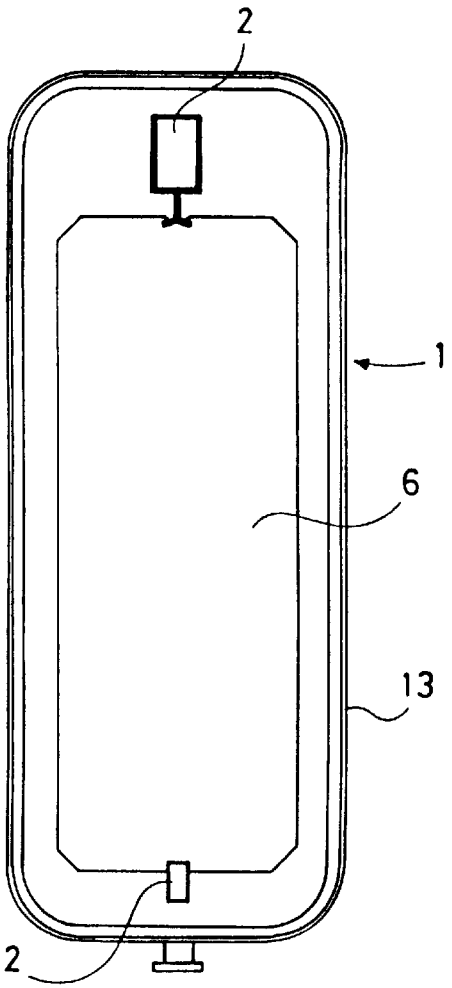
FIG. 7 shows a cross-section of an alternately designed plate heat exchanger according to the invention.

In FIGS. 7 to 9 details, which correspond to the plate heat exchanger according to FIG. 1, have been given the same reference numerals. In addition a tension means in the shape of a frame 13 and a seal 27 is shown.

According to the invention the package 5 is covered by means of the cover 8, which preferably consists of an elastomer, such as a rubber sheeting, plastic or similar, which seals closely around the outer edges 9 of the frame and the pressure plate. A certain abutment pressure is required between the cover 8 and the underlying end plate to achieve necessary tightness. Along the outer edge 9 of the end plates 3 and 4 a special tension means is provided, which causes a pressure towards the cover 8.

As appears from FIG. 2 the end plates 3 and 4 are formed with unbroken outer edges 9, i.e. they have no open recess for tightening bolts 7 or carrying bars 2. They will not have any sharp corners and instead they are made with sufficient radii. The outer edges 9 of the end plates 3 and 4 are thus continuously convex. An appropriate embodiment is that the end plates 3 and 4 are formed with a circular or oval shape, i.e. the outer edge 9 is more or less curved. The sealing pressure can be obtained by means of the tension means, which appears closer in FIGS. 5 and 6, and which consists of a band 10 located outside the cover 8 around the end plate 3 and 4, respectively, in which the strap abuts towards the outer edge 9 of the respective end plate. The strap 10 may consist of metal, plastic or other suitable material. To prevent wear of the cover 8 during assembly and dismantling a protective strip 11 of rubber or similar material may be inserted between the strap 10 and the cover 8.

The strap 10 can be tightened by aid of a tension bolt 12 as shown in FIG. 6 or by aid of other known tension means.

The end plates 3 and 4 can also be formed having an arbitrary shape. The sealing pressure may be accomplished by means of frames 13 of approximately the same shape as the end plates 3 and 4, which are mounted to the respective end plate, as appears from FIGS. 7 to 9, in such a way that the cover 8 is clamped by means of a seal 27 between the frame 13 and the end plates 3 and 4. The frame 13 may also be made of strips or other similar clamping means. Naturally, it may also be possible to fasten the cover by gluing against the end plates, but this should be inappropriate referring to the ability of dismantling the plate heat exchanger.

All holes and slots in the end plates 3 and 4 must also be sealed. FIG. 3 shows one way to seal a recess 14 for the carrying bar with help of an O-ring 15, which is pressed towards the end plate 3 and the carrying bar by means of a joint washer 16, which is screwed in the end plate. FIG. 4 shows an arrangement to seal the recess of the tightening bolt 17 by means of a joint washer 18 having an O-ring 19, which seals against the end plate and a seal 20, which seals against the nut 21 and 22 of the tightening bolt. Both these solutions allow opening and clamping of the plate package without replacement of said gaskets. The holes and the slots that may be sealed permanently, i.e. the slit between a possible lining and the frame plate 3 and 4, are preferably sealed by any sort of sealing compound.

To drain possible condensate, formed on the interior of the cover 8, a drainage valve 23 is shown in FIG. 1 in the lower portion of the cover. In addition, connection nipples 24, 25, which can be used to supply an inert gas in the space between the cover 8 and package 5, are shown in FIG. 1. The inert gas may consist of nitrogen gas or carbon dioxide when no exchange of gas occurs around the package 5, or steam if one lets the inert gas pass through the mentioned space continuously. Specifically, applied to plate heat exchangers working with water or steam, the supply of protective gas may be arranged very easily—by using the same steam as used as heating fluid—to flow from a leakage space to the space between the cover and package.

The present invention generally also refers to a method of protecting rubber gaskets, or other oxidizing gaskets, in a plate heat exchanger from being exposed to the oxygen in the surrounding atmosphere after the tightening of the plate heat exchanger. The parts of the gaskets of the plate heat exchanger, which are exposed towards the surrounding atmosphere, are thus covered by a cover. The cover is essentially hermetic and may consist of rubber, plastic or other suitable material. Also metal plate could be used, but the cost to achieve sealed joints towards the end plates makes such material less suitable. The cover is arranged at a distance from the rubber gaskets, partly so that the temperature of the cover will not become too high and partly to make it possible that the space between the cover and the rubber gaskets could be evacuated or supplied with an inert gas to further protect the gasket material from oxidation.

What is claimed is:

1. A plate heat exchanger (1) comprising a frame (2) with two end plates (3, 4) and between them a package (5) of heat transfer plates (6) with intermediate gaskets, which define flow spaces for at least two heat transfer fluids, and a cover (8) extending around said package (5), wherein the cover (8) is arranged against the outer edge (9) of each end plate (3, 4) at a distance from said package (5), so that a space sealed from the surrounding atmosphere and isolated from said flow spaces is created between the cover (8) and said package (5), and wherein said end plates act to compress the package of heat transfer plates and gaskets.

2. A plate heat exchanger (1) comprising a frame (2) with two end plates (3, 4) and between them a package (5) of heat transfer plates (6) with intermediate gaskets, which define flow spaces for at least two heat transfer fluids, and a cover (8) extending around said package (5), wherein the cover (8) abuts closely against the end plates (3, 4) and is arranged at a distance from said package (5), so that a space sealed from the surrounding atmosphere is created between the cover (8) and said package (5), the cover (8) is arranged against the outer edge (9) of each end plate, and a tension means presses the cover (8) against the outer edge (9) of each end plate.

3. A plate heat exchanger according to claim 2, wherein the outer edge (9) of each end plate is continuously convex, and the tension means is formed of a strap (10), extending around said outer edge (9).

4. A plate heat exchanger according to claim 2, wherein the tension means is formed as a frame (13) or a strip, with essentially the same shape as the outer edge (9) of the end plate, and the cover (8) is pressed between the frame (13) or the strip, and the end plate (3,4).

5. A plate heat exchanger according to claim 1, wherein the cover (8) or any of the end plates (3,4) comprises means for supplying protective gas to the space, or means for evacuation of the space, between the cover (8) and the package (5).

6. A plate heat exchanger according to claim 5, wherein said means for supplying protective gas comprises means for supplying steam.

7. A plate heat exchanger (1) comprising a frame (2) with two end plates (3, 4) and between them a package (5) of heat transfer plates (6) with intermediate gaskets, which define flow spaces for at least two heat transfer fluids, and a cover (8) extending around said package (5), wherein the cover (8) abuts closely against the end plates (3, 4) and is arranged at a distance from said package (5), so that a space sealed from the surrounding atmosphere is created between the cover (8) and said package (5), said cover (8) comprising an elastomer.

8. A plate heat exchanger according to claim 7, wherein the cover (8) has an outer protective shield (26) of metal.

* * * * *

UNITED STATES PATENT AND TRADEMARK OFFICE

CERTIFICATE OF CORRECTION

PATENT NO. : 5,860,470

DATED : Jan. 19, 1999

INVENTOR(S) : Andersson et al.

It is certified that error appears in the above-identified patent and that said Letters Patent is hereby corrected as shown below:

Col. 2, line 6, change "on" to --at--.

Signed and Sealed this

Eighth Day of June, 1999

*Attest:*

Q. TODD DICKINSON

*Attesting Officer*

*Acting Commissioner of Patents and Trademarks*